US005609518A

United States Patent [19]

Lucchesi

[11] Patent Number: 5,609,518

[45] Date of Patent: Mar. 11, 1997

[54] GRINDING WHEEL FOR FORMING CONVEX SHAPES, APPLICABLE IN PARTICULAR TO MANUAL GRINDERS

[75] Inventor: Mario Lucchesi, Venezia, Italy

[73] Assignee: Vincent S.r.l., Italy

[21] Appl. No.: 327,283

[22] Filed: Oct. 21, 1994

[30] Foreign Application Priority Data

Oct. 25, 1993 [IT] Italy ..... MI93U0819

[51] Int. Cl.[6] ..... B23F 21/03

[52] U.S. Cl. ..... 451/541; 451/913; 144/218; 144/134.1

[58] Field of Search ..... 451/913, 541, 451/544, 545, 540, 546

[56] References Cited

U.S. PATENT DOCUMENTS

| | | | |
|---|---|---|---|
| 3,016,661 | 1/1962 | Nielsen | 451/541 |
| 4,606,154 | 8/1986 | Herrmann et al. | 451/541 |
| 4,611,438 | 9/1986 | Siden | 451/541 |
| 4,977,709 | 12/1990 | Siden | 451/541 |
| 4,989,375 | 2/1991 | Henmi et al. | 451/546 |

FOREIGN PATENT DOCUMENTS

| | | |
|---|---|---|
| 0397955 | 11/1990 | European Pat. Off. . |
| 3138163 | 4/1983 | Germany . |

*Primary Examiner*—James G. Smith
*Assistant Examiner*—Dona C. Edwards
*Attorney, Agent, or Firm*—Hedman, Gibson & Costigan, P.C.

[57] ABSTRACT

An abrasive grinding wheel (1) is described which has a concavity (8) in the abrasive in which a metal ring (4) is embedded. The metal ring (4) is non-abrasive but is sufficiently hard to resist wear by rubbing against the material being ground. The grinding wheel (1) hence removes material only until the metal ring (4) encounters the summit of the convex shape obtained. The metal ring (4) therefore operates as a stop-rest which automatically prevents superfluous removal of material.

7 Claims, 2 Drawing Sheets

GRINDING WHEEL FOR FORMING CONVEX SHAPES, APPLICABLE IN PARTICULAR TO MANUAL GRINDERS

BACKGROUND OF THE INVENTION

This invention relates to a grinding wheel for forming convex shapes which is applicable in particular to manual grinders. Grinding wheels in accordance with the introduction to claim 1 are known.

Such grinding wheels are available with different mechanical characteristics so as to be suitable for operating properly on practically any commonly available construction material. The different mechanical characteristics are obtained by combining binders of different toughness with abrasive particles of various hardness and size.

Although these grinding wheels operate satisfactorily, they are subject to wear requiring their periodic dressing or replacement, which is known to considerably influence costs. However the problem is particularly felt in the case of grinding wheels used on manually controlled grinders for rough-grinding convex shapes. In manually controlled grinders, whether of portable or non-portable type, identifying the moment in which grinding can be considered terminated is left to the experience of the operator. If this moment is not identified in good time, superfluous removal of material results, with consequent superfluous wear of the grinding wheel. In this respect, in such cases the grinding wheel progressively generates new convex surfaces which are not better in terms either of shape or of surface finish than those which were previously obtained and then immediately removed by the effect of advancing the grinding wheel.

The object of the present invention is to provide a grinding wheel for forming convex shapes which obviates the aforesaid drawback, ie to provide a grinding wheel able to prevent superfluous material removal and hence superfluous wear thereof.

SUMMARY OF THE INVENTION

The invention in concerned with a grinding wheel for forming convex shapes using a manually controlled grinder. The grinding wheel comprises an abrasive mass(2) arranged about an axis of rotation (5) and shaped to present at least one concavity (8) wherein the base of the concavity has embedded therein an element (4) which counteracts with the surface being ground and has a profile which is identical to the profile of the concavity. The Element (4) has is coaxial with the axis of rotation and is made of a non-abrasive material which is more resistant to abrasion and tendentially harder than the abrasive mass (2) in which it is positioned.

During grinding, the grinding wheel removes material only until the counteracting element engages the summit of the convex shape obtained. The counteracting element therefore operates as a stop-rest which automatically prevents superfluous material removal when it comes into contact with the surface being machined. The mechanical characteristics and the width of said counteracting element are chosen on the basis of the material for which the grinding wheel is intended, resistance to wear by rubbing and resilience (impact strength) being the reference characteristics for this choice.

The mechanical characteristics of the counteracting element must be such as to limit at the appropriate moment the removal effect of the grinding wheel, but must also be such as to allow coherently proportional wear of the ring on consumption of the abrasive mass so that the grinding wheel preserves its correct geometry for as long as possible.

DESCRIPTION OF THE PREFERRED EMBODIMENTS

Figure 1:
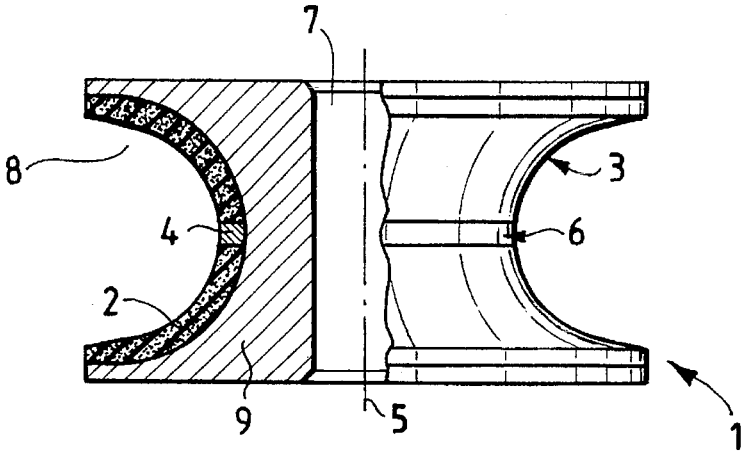
FIG. 1 is a side view of a grinding wheel of the invention with a partial cutaway section.

With reference to said figures and in particular FIG. 1, the grinding wheel of the invention indicated overall by 1 is of the type for forming a convex shape, the abrasive mass 2 consequently being in the form of a solid of revolution in which the lateral surface 3, intended to interact with the workpiece to be shaped, comprises a concavity 8. In the embodiment shown in FIG. 1 the shape of said lateral surface 3 is semi-circular. The profile of the lateral surface 3 of the grinding wheel illustrated in FIG. 1 is commonly known as a "V" profile. The profile of the lateral surfaces 3 of the grinding wheels 1A–1E illustrated in FIGS. 2–6 are commonly known as a "D" profile, a "G" profile, an "M" profile, a "T" profile and an "X" profile respectively. In the illustrated embodiments the abrasive mass 2 is reduced to a portion covering a support mass 9 of metal, preferably steel or bronze. At the base of the concavity 8 and embedded in the abrasive mass 2 there is positioned a counteracting element 4 coaxial to the axis of rotation 5 of the grinding wheel. As the abrasive mass 2 is supported by the mass 9, the counteracting element 4 is made annular to ensure a continuous counteracting and support action along its entire lateral surface 6. The lateral surface 6 of the annular counteracting element 4 has the same shape as and blends into the lateral surface 3 of the abrasive mass 2 so as not to interrupt, but instead to ensure, its congruency and hence its geometrical continuity.

The grinding wheel 1 is particularly suitable for use in rough-grinding toroidal marble and/or granite articles on manually controlled machines, whether portable or fixed.

During grinding the grinding wheel is able to advance and remove material only until the annular counteracting element 4 encounters the cusp of the convex shape obtained. In this respect, when the annular counteracting element 4 engages the cusp of the convex shape, being unable to abrade the material it behaves as a stop-rest which enables the grinding wheel to operate idly even though in engagement with the workpiece. The annular counteracting element hence ensures that a constant grinding depth is automatically obtained, so enabling a degree of finishing and precision to be achieved which is greater than the qualitative standards currently obtainable with manually controlled machines whether portable or fixed. The annular counteracting element 4 prevents superfluous material removal, allows better utilization of the grinding wheel between two successive dressings, and hence in the final analysis also increases the life of the grinding wheel in which it is contained. The annular element 4 is of a non-abrasive material which is tendentially harder and more resistant both to wear by abrasion and to impact than the material of the abrasive mass 2, however the hardness characteristics of this ring must at the same time be such as to ensure ring wear proportional to the consumption of the grinding wheel so that the concavity preserves its optimum form with time. Having selected the material of the annular element 4 the expert defines the optimum width of the lateral surface 6 on the basis of the composition of the abrasive mass 2 and of the material which the grinding wheel is to grind, and on the basis of the width of the concavity 8. The annular counteracting element 4 must also be of such mechanical characteristics as to be able to withstand the pressure and temperature of the sintering process to which it is necessarily subjected during the grinding wheel manufacture. In this respect the grinding wheel 1 is formed by sintering a binder-diamond agglomerate onto said annular counteracting element 4 and onto the support mass 9, and providing a coupling hole 7. The annular counteracting element 4 is of sintered ceramic or metal and can be composed of various materials, such as hard metal (sintered metal carbides), ceramic insert, cermet (ceramic/metal), cubic boron nitride or metal/ceramic. These materials, which are currently used for forming steel working tools, are distinguished by high abrasion resistance.

It is important to note that the possible small width of the annular counteracting element 4 coming into contact with the material being ground does not prejudice the subsequent use of finishing grinding wheels for achieving high surface quality. In this respect, the finishing grinding wheels are preferably without the annular counteracting element 4, which would be substantially superfluous in achieving a high degree of finish in which the amount to be removed is extremely small and uniform over the entire surface being ground.

FIGS. 2–6 show by way of example further convex-shaping grinding wheels which are also provided with the annular counteracting element 4, they being indicated by 1A–1E respectively. As already seen these differ from the grinding wheel 1 mainly by the shape and extension of the lateral surface, which can vary according to requirements to even include more than one concavity and be provided with more than one annular counteracting element 4.

Figure 2:
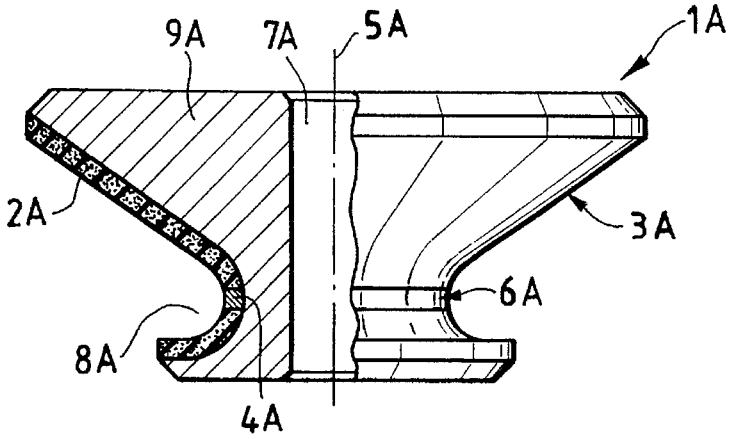
FIG. 2 is a side view of a grinding wheel of the invention with a partial cutaway section.

FIG. 2 shows a grinding wheel 1A having an axis of rotation 5A, a concavity 8A, a support mass 9A which supports abrasive mass 2A, a counteracting element 4A, lateral surface 3A, lateral surface of the counteracting element 6A, coupling hole 7A and a concavity 8A.

Figure 3:
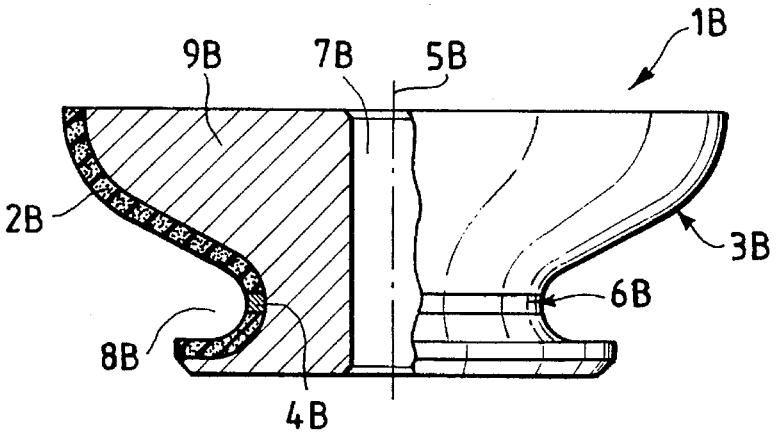
FIG. 3 is a side view of a grinding wheel of the invention with a partial cutaway section.

FIG. 3 shows a grinding wheel lB having an axis of rotation 5B, a concavity 8B, a support mass 9B which supports abrasive mass 2B, a counteracting element 4B, lateral surface 3B, lateral surface of the counteracting element 6B, coupling hole 7B and a concavity 8B.

Figure 4:
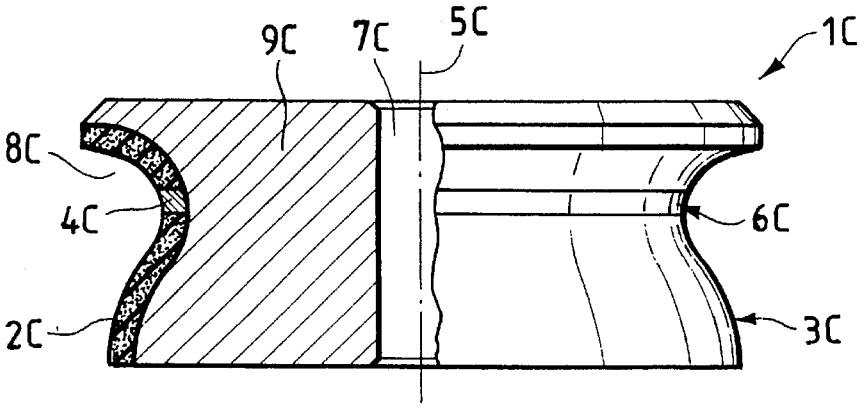
FIG. 4 is a side view of a grinding wheel of the invention with a partial cutaway section.

FIG. 4 shows a grinding wheel 1C having an axis of rotation 5C, a concavity 8C, a support mass 9C which supports abrasive mass 2C, a counteracting element 4C, lateral surface 3C, lateral surface of the counteracting element 6C, coupling hole 7C and a concavity 8C.

Figure 5:
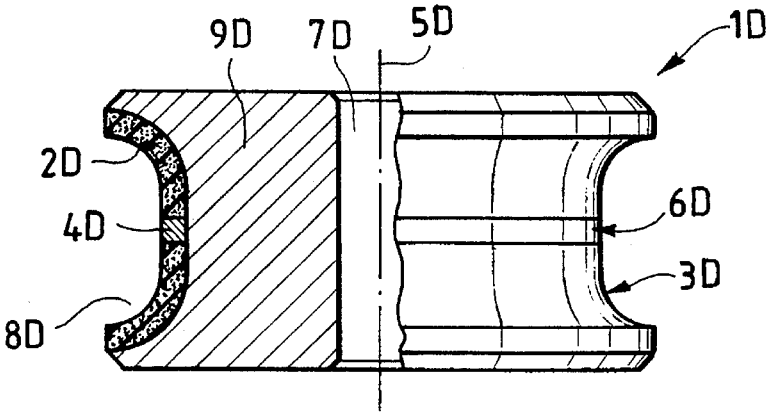
FIG. 5 is a side view of a grinding wheel of the invention with a partial cutaway section.

FIG. 5 shows a grinding wheel 1D having an axis of rotation 5D, a concavity 8D, a support mass 9D which supports abrasive mass 2D, a counteracting element 4D, lateral surface 3D, lateral surface of the counteracting element 6D, coupling hole 7D and a concavity 8D.

Figure 6:
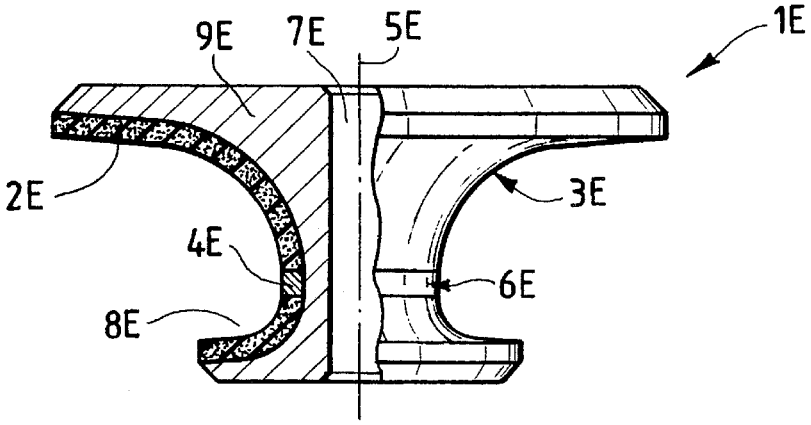
FIG. 6 is a side view of a grinding wheel of the invention with a partial cutaway section.

FIG. 6 shows a grinding wheel 1E having an axis of rotation 5E, a concavity 8E, a support mass 9E which supports abrasive mass 2E, a counteracting element 4E, lateral surface 3A, lateral surface of the counteracting element 6E, coupling hole 7E and a concavity 8E.

I claim:

1. A grinding wheel (1) for forming convex shapes applicable in particular to manually controlled grinders, comprising an abrasive mass (2) arranged about an axis of rotation (5) and shaped to present at least one concavity (8), characterised in that at the base of said concavity (8) and embedded in the abrasive mass (2) there is provided an element (4) which counteracts with the surface being ground, is of identical profile to that of the concavity and is coaxial with the axis of rotation, said counteracting element (4) being of a non-abrasive material which is more resistant to wear by abrasion and tendentially harder than the abrasive mass (2) in which it is positioned.

2. A grinding wheel as claimed in claim 1, characterised in that the abrasive mass (2) consists of a portion covering a support mass (9), the counteracting element being a ring (4) embedded only in said abrasive mass (2).

3. A grinding wheel as claimed in claim 1, characterised in that said counteracting element (4) is a ring of sintered metal.

4. A grinding wheel as claimed in claim 3, characterised in that the material of the counteracting element is chosen from sintered metal carbides.

5. A grinding wheel as claimed in claim 1, characterised in that said counteracting element (4) is a ring of sintered ceramic material.

6. A grinding wheel as claimed in claim 5, characterized in that the material of the counteracting element is selected from the group consisting of ceramic insert, cermet and metal ceramic.

7. A grinding wheel as claimed in claim 1, characterised in that the material of the counteracting element is cubic boron nitride.

* * * * *